US005787738A

United States Patent [19]

Brandt et al.

[11] Patent Number: 5,787,738

[45] Date of Patent: Aug. 4, 1998

[54] SECURITY LOCK FOR A LAPTOP COMPUTER

[76] Inventors: Dean M. Brandt, #3 Creek Crest Ct., Allen, Tex. 75002; Lawrence A. Fish, 508 Willow Way, Wylie, Tex. 75098

[21] Appl. No.: 769,229

[22] Filed: Dec. 18, 1996

[51] Int. Cl.[6] ..... E05B 69/00

[52] U.S. Cl. ..... 70/58; 70/14; 70/18

[58] Field of Search ..... 70/58, 14, 18, 70/57

[56] References Cited

U.S. PATENT DOCUMENTS

| | | | |
|---|---|---|---|
| 3,707,860 | 1/1973 | Singer et al. | 70/58 |
| 4,738,428 | 4/1988 | Themistos et al. | 70/58 |
| 4,821,538 | 4/1989 | Gray | 70/58 |
| 4,856,304 | 8/1989 | Derman | 70/58 |
| 5,345,219 | 9/1994 | Rogers | 340/568 |
| 5,351,508 | 10/1994 | Kelley | 70/58 |
| 5,361,610 | 11/1994 | Sanders | 70/14 |
| 5,406,809 | 4/1995 | Igelmund | 70/58 |
| 5,608,605 | 3/1997 | Siow et al. | 70/58 |

*Primary Examiner*—Steven N. Meyers
*Assistant Examiner*—Tuyet-Phuong Pham
*Attorney, Agent, or Firm*—Sidley & Austin

[57] ABSTRACT

A security lock for a computer, such as a laptop. The security lock includes a blade member that can freely pass through the gap between the computer display and keyboard. Attached to one end of the blade member is a blocking member which is larger than the gap. The other end of the blade member is attached or otherwise fastened to a fixed object, via a padlock, to thereby secure the computer to the fixed object. Theft or unauthorized removal of the computer is thereby prevented.

19 Claims, 6 Drawing Sheets

SECURITY LOCK FOR A LAPTOP COMPUTER

TECHNICAL FIELD OF THE INVENTION

The present invention relates in general to anti-theft and locking devices, and more particularly to devices and techniques for securing computers, and the like, to prevent the theft thereof.

BACKGROUND OF THE INVENTION

The security and prevention of theft of computers has become a major concern, in that computers are expensive items and are generally of a size that can be easily handled and carried. The problem is even more exacerbated with laptop computers, which often are no larger than a notebook. As such, laptop computers can be easily placed in briefcases, purses or other containers and carried away without being noticed. Laptop computers currently cost between about $1,500.00 and $5,000.00. However, sophisticated laptop computers with numerous functions can range up to $20,000.00 in value. Accordingly, it can be seen that the security of laptop computers is a major concern to businesses and other entities that provide such type of computers to its employees.

Efforts have been made in the past to prevent the theft or unauthorized removal of laptop computers from an office or other business area. Some laptop computers have been constructed with a small apertured tab that can be extended from a slot in the computer housing. The tab has a hole therethrough for fastening an anchor thereto, such as a tether cord or cable. However, these tabs are generally constructed of a thin metal and are small in size, whereby they can be severed by continued flexing until the metal fatigues and then breaks.

Other techniques involve the adhering to the laptop computer an anchor plate made of a durable material and having one or more loops or eye hooks. A padlock and tether can be anchored through the eyehook in an attempt to secure the laptop computer to a fixed object. While these devices do enhance the security of computers, it has been found that the anchor plate can nevertheless be pried off the computer with a screwdriver, or the like. The computer can then be easily removed and taken.

Yet another technique for securing computers, and the like, involves the fabrication of a square block of a polymer material with two sets of holes drilled through the block, at right angles to each other. In this manner, a screw can be extended through one hole for fastening the block to a computer cabinet or frame. Thereafter, the shackle of a padlock is passed through the other orthogonal hole, and locked. In this manner, access to the head of the screw is blocked by the padlock shackle so that a screwdriver cannot be employed to remove the block from the computer. While this arrangement appears to work satisfactorily, the block necessarily extends from the cabinet of the computer and thereby presents an annoyance. Further, there is always a risk of damaging or short-circuiting circuits within the computer when the screw is fastened through the sidewall of the computer cabinet.

From the foregoing, it can be seen that a need exists for an improved security lock for a laptop or other type of computer. A need exists for a computer lock that does not require any modification of the computer itself and that is easily installed to secure the computer, and is easily removed to free the computer for mobility thereof. Another need exists for a security lock that is inexpensive to fabricate and that does not need complicated and expensive molds or fabrication techniques for the manufacture thereof.

SUMMARY OF THE INVENTION

The present invention overcomes the disadvantages and shortcomings of the prior art security locks. In accordance with a preferred embodiment of the invention, the security lock is readily adapted for use with laptop computers having a display hingeably mounted to a keyboard. Typically, because of the hinged parts, there is a gap between the display and the keyboard for allowing hinged movement therebetween. In the preferred embodiment of the invention, the security lock includes a blade member constructed of a durable material that has a thickness so as to be insertable in the gap between the laptop display and keyboard. One end of the blade has an enlarged blocking member fastened thereto that is larger than the gap. The other end of the blade member includes a hole therethrough for receiving the shackle of a padlock.

When securing a laptop computer according to the invention, the apertured end of the blade member is passed through the gap between the computer display and keyboard, until the blocking member prevents further movement. Then the shackle of a padlock is passed through the hole in the blade member, as well as through the loop of a tether cable. The tether cable is fixed or otherwise anchored to a fixed object. In this manner, the laptop computer is secured and prevented from unauthorized removal.

In another embodiment, the blade member has an aperture at both ends thereof. An anchor cable is looped through one hole and permanently fixed to the blade. The free end of the blade is then passed through the gap between the computer display and keyboard. Lastly, the shackle of a padlock is passed through the other hole in the free end of the blade to thereby secure the computer to the fixed object, via the tether cable.

The security lock can be made with an electrical switch attached thereto to sense removal of the lock from the computer. The switch can be connected to an alarm or other monitor system to sense if unauthorized removal of the lock from the computer is being attempted.

It can be seen that the security lock constructed in accordance with the invention is economically constructed, easily used, and provides a high degree of security to laptop computers. Further, no modifications whatsoever need be made to the laptop computer itself to accommodate the securement thereof by way of the present invention.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts or elements throughout the views, and in which.

DETAILED DESCRIPTION OF THE INVENTION

Figure 1:
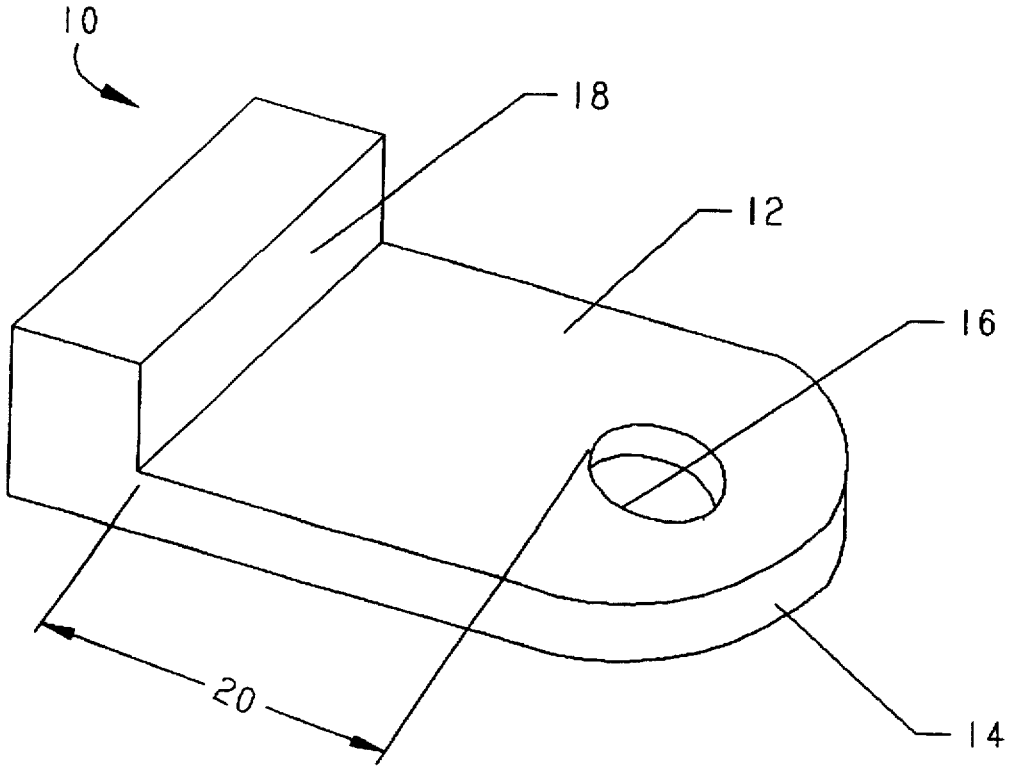
FIG. 1 is an isometric view illustrating the principles and concepts of the preferred embodiment of the invention.

With reference to FIG. 1, there is illustrated the security lock according to the preferred embodiment of the invention. The security lock 10 includes a blade member 12 that is generally planar and of a thickness sufficient to pass through the gap between the display and keyboard of a laptop computer. The security lock 10 is preferably constructed of a durable or rugged material such as aluminum, steel, etc. Indeed, those skilled in the art may find certain advantages in constructing or molding the security lock 10 of a synthetic, durable material such as plastic or nylon. The blade member 12 includes a first end that has a rounded edge 14 to facilitate insertion in the gap between the computer display and keyboard. Formed in the first end of the blade member 12 is a hole 16. The hole 16 is of a sufficient diameter to allow the shackle of a padlock or other locking device to easily pass therethrough.

Formed or otherwise machined at the second end of the blade member 12 is a blocking member 18 that is made integral to the blade member 12. The blocking member 18 can be square or rectangular in shape, as shown, and is formed orthogonal to the general planar surface of the blade member 12. The height of the blocking member 18, together with the thickness of the blade member 12, is preferably greater than the height of the gap between the computer display and keyboard. In this manner, the blocking member 18 prevents the security lock 10 from being inserted or extended entirely through the gap.

The security lock 10 is preferably formed from a unitary block of metal, such as aluminum. The initial metal stock is as thick as the height of the security lock 10 at the blocking member 18. Metal is removed by machining, to thereby leave the appropriate thickness of the blade member 12. Alternatively, a block of metal stock can be welded to a thinner metal piece to thereby provide a thin blade member with an integral thicker or enlarged end. The lock can also be cast or molded from a suitable material. Lastly, a hole 16 is bored in the end of the blade member 12 of a size suitable for receiving the shackle of a padlock.

In accordance with an important feature of the invention, the dimension 20 shown in FIG. 1 is only a small amount greater than the thickness of the laptop computer display. With this arrangement, when the security lock 10 is in place and locked, it is difficult to flex any portion of the blade member 12 to fatigue the material and effectively break the blade member 12 in two pieces. Stated another way, the small portion of the curved end of the blade member 12 that is accessible is ineffectively gripped to thereby flex the blade member and cause metal fatigue.

A view of the opposite side of the security lock 10 is identical to that shown in FIG. 1. Moreover, a back view of the lock of FIG. 1 constitutes a rectangle with a flat planar surface. While the semi-circular edge 14 of the security lock 10 facilitates insertion in the gap of the laptop computer, it is not a necessity that the shape be semicircular. Rather, the leading edge of the blade member 12 can be substantially linear with either rounded or diagonal corners. Further, the leading edge of the blade member 12 can be somewhat sharpened to further facilitate insertion in the gap between the computer display and keyboard. The blocking member 18 need not be formed of a solid material, but can be of other shapes, as well as an end of the blade member 12 that is bent upon itself, or otherwise formed to define an enlarged end that is thicker, wider or bulkier than the gap.

In accordance with the preferred form of the invention, the blocking member 18 is between about one-half to one-quarter inch high, and the blade member is about one inch wide, with a thickness between about 0.25 and 0.055 inch to accommodate different types of laptop computers. Moreover, the dimension 20 shown in FIG. 1 is preferably about 0.90 inch, again dependent upon the particular type of laptop computer.

Figure 2:
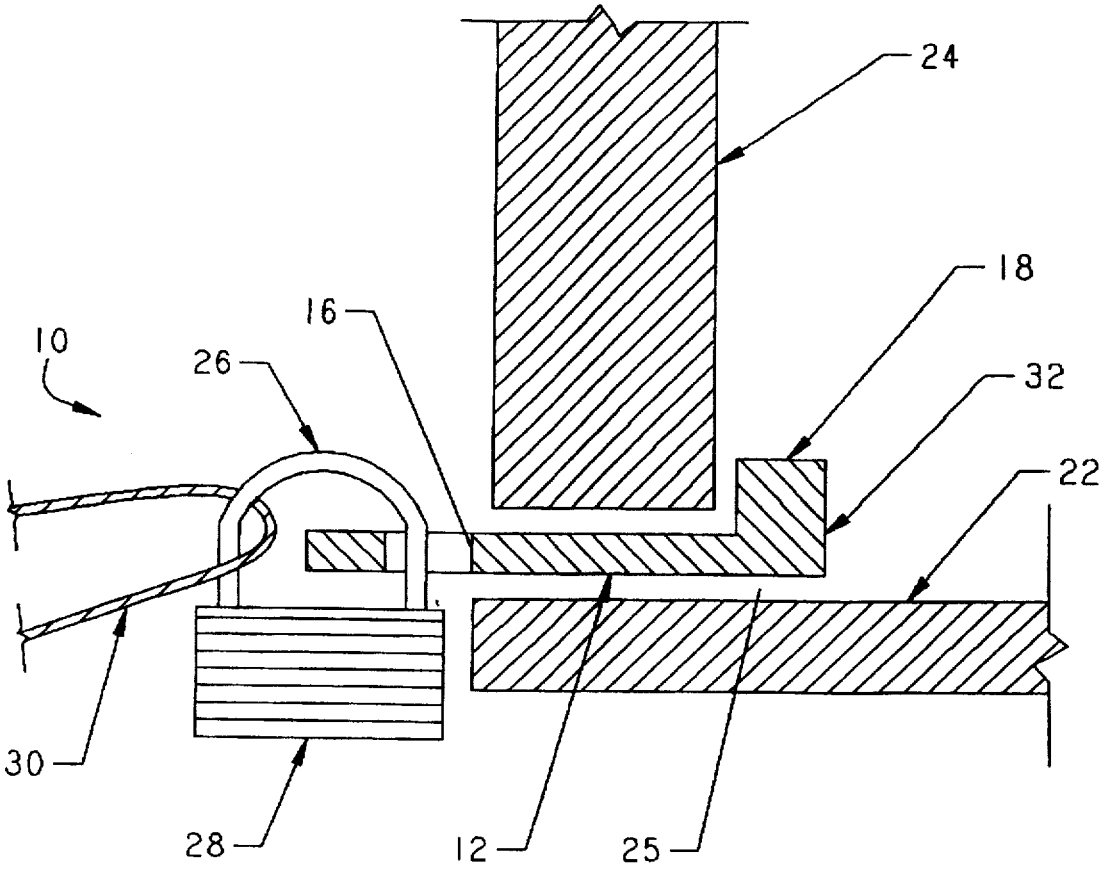
FIG. 2 is a cross-sectional view taken between the display and keyboard of a laptop computer, showing the blade member of the security lock extending through the gap to thereby secure the computer to a tether cord.

FIG. 2 is a cross-sectional view illustrating the locking capabilities of the security lock 10 when attached to a laptop computer. The laptop computer is shown having a keyboard 22, a hinged display 24 and a gap 25 therebetween. The hole 16 in the blade member 12 is shown with the shackle 26 of a padlock 28 secured therein. A tether cord or cable 30 is shown threaded through the padlock shackle 26, thereby securing the cable 30 to the security lock 10. Those skilled in the art may prefer to form the hole 44 as an eyehook or other similar structure to which the padlock shackle 26 can be fastened. The cable 30 is connected or otherwise fixed to a fixed object, such as a table, chair, wall, etc. (not shown).

In accordance with an important feature of the invention, and as noted above, the distance between the blade member hole 16 and the blocking member 18 is only somewhat greater than the thickness of the laptop computer display 24. With this construction, it is difficult to bend the blade member 12 in a wide arc which would otherwise allow the material thereof to fatigue and possibly separate. In addition, this construction makes it difficult to saw or otherwise mutilate the blade member 12 to remove the security lock 10 from the laptop computer. It can also be seen that with the blade member 12 and the blocking member 18 forming an internal perpendicular corner, the security lock 10 cannot be pulled through the gap 25 without ruining or destroying the laptop computer. Moreover, the security lock 10 is of such a sturdy and rugged construction that the blocking member 18 is not deformed or otherwise removable or separable from the blade member 12, thereby enhancing the security afforded thereby. The back face 32 of the security lock 10 is planar and may thereby have affixed thereto a warning label or other indicia, notifying personnel of the existence of the security lock 10.

Figure 3:
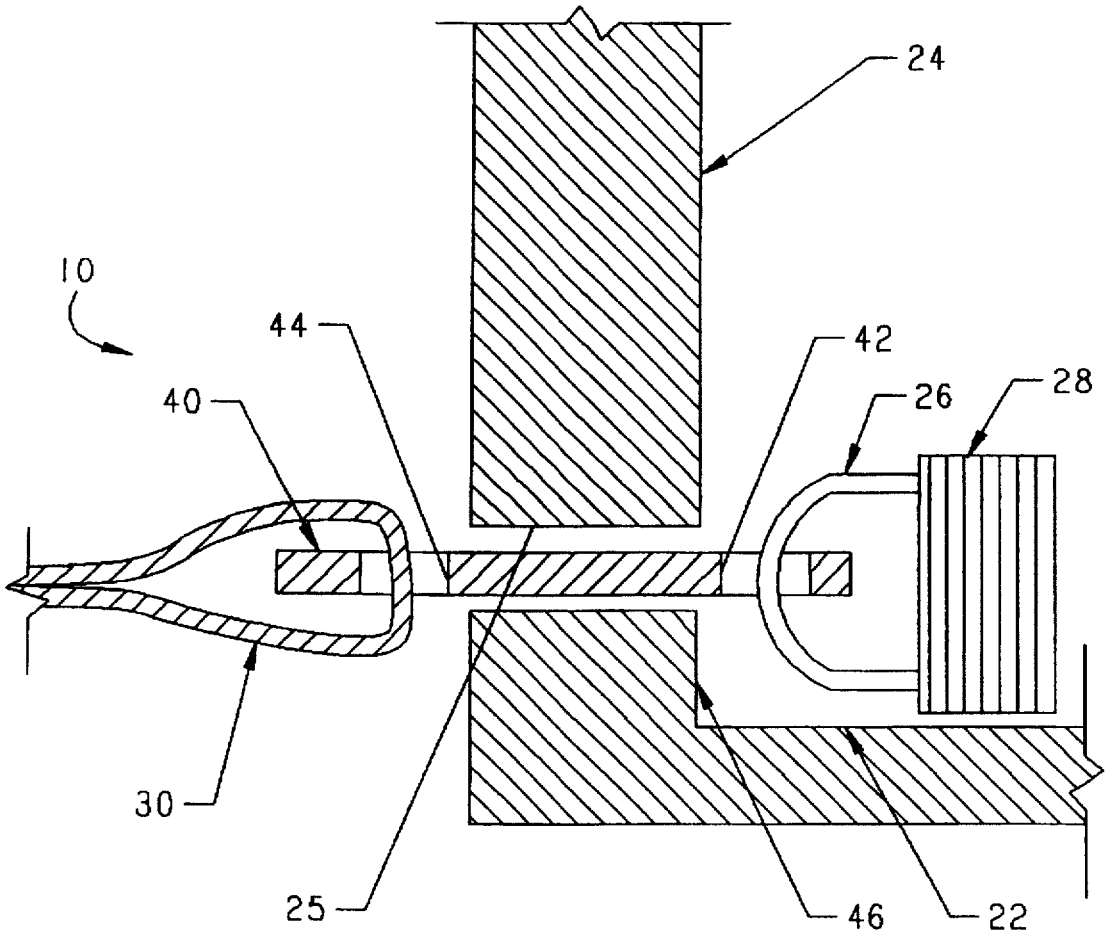
FIG. 3 illustrates a cross-sectional view of another embodiment of the security lock according to the invention.

With reference to FIG. 3, there is shown another embodiment according to the principles and concepts of the invention. Here, a blade member 40 includes a first hole 42 for accommodating the shackle 26 of a padlock 28. A second hole 44 located at the other end of the blade member 40 accommodates the looped end of a tether cable 30. With this arrangement, the padlock 20 constitutes the blocking member for preventing removal of the laptop computer from the anchored tether cable 30 and attached blade member 40. The blade member 40 can be bent or otherwise curved upwardly to facilitate engagement of the padlock 28 therewith. The blade member 12 can also be permanently curved to conform to a curvature of the gap. In order to remove the security lock 10, the padlock 28 need only be unlocked and removed, and the laptop computer pulled away from the anchored blade member 40.

In yet another alternative embodiment of the invention, the anchor cable 30 can be eliminated, as well as the hole 44, and the blade member 20 can be welded or fastened to a wall mount, or other plate that is rigidly fixed to a security shelf or table. Indeed, in order to secure a number of laptop computers during nonuse, a number of five-sided compartments can be fabricated, with the back of each compartment having welded thereto the blade member 40. When a laptop computer is desired to be secured during a period of nonuse, it can be slid into the compartment so that the blade member 40 is inserted through the gap 25, and a padlock or other type of lock fixed to the frontal end of the blade member, via the hole 42.

Figure 4:
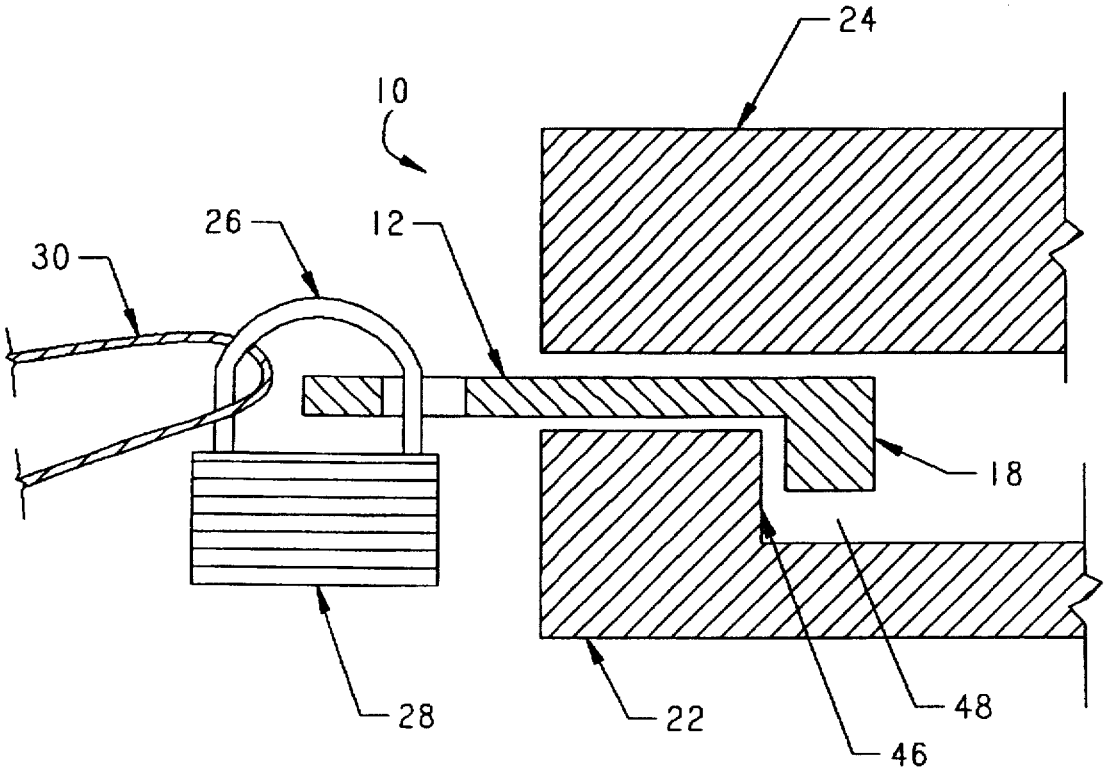
FIG. 4 is a cross-sectional view of a laptop computer of the type having a recessed area therein to accommodate the security lock when the computer display is hinged to a closed position.

In the embodiment shown in FIG. 4, there is shown a laptop computer of the type having a recess 48 for receiving therein the blocking member 18. It can be realized that the security lock 10 shown in FIG. 2 can be rotated 180 degrees and utilized in the laptop computer shown in FIG. 4. In this configuration, the blocking member 18 abuts against the small upright portion 46 of the computer keyboard 42.

Figure 5:
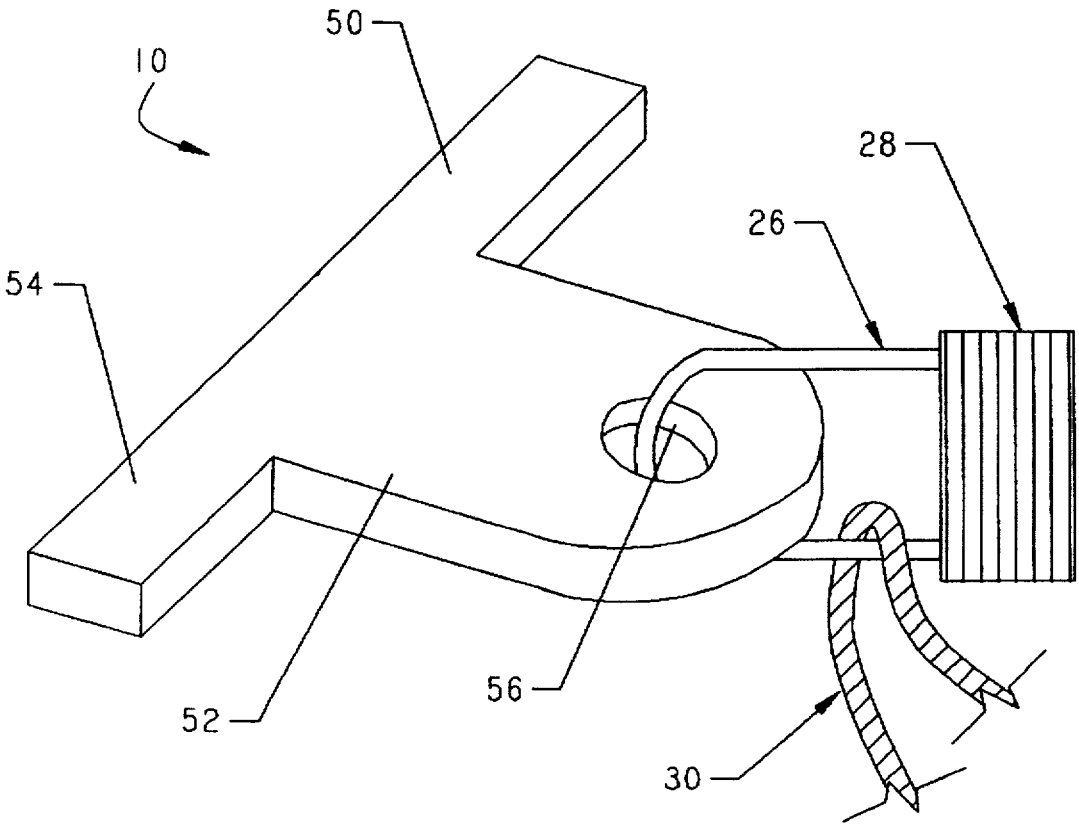
FIG. 5 is an isometric view of a T-shaped security lock according to another embodiment of the invention.

Yet another embodiment of the invention is shown in FIG. 5. In this embodiment, the security lock includes a T-shaped blade member 50. The T-shaped blade member 50 includes a blade 52 that is of a thickness suitable for insertion in the gap between the display and keyboard of laptop computer. Attached to the blade 52 is a cross arm 54 that is wider than the gap in the laptop computer. Although the cross member 54 can be of the same thickness as the blade 52, those skilled in the art may find that the thickness of the cross bar can also be greater than that of the blade 52. Again, a hole 56 in the blade 52 accommodates the shackle 26 of a padlock 28 for securing the computer to a fixed object (not shown) via the tether cable 30.

Figure 6:
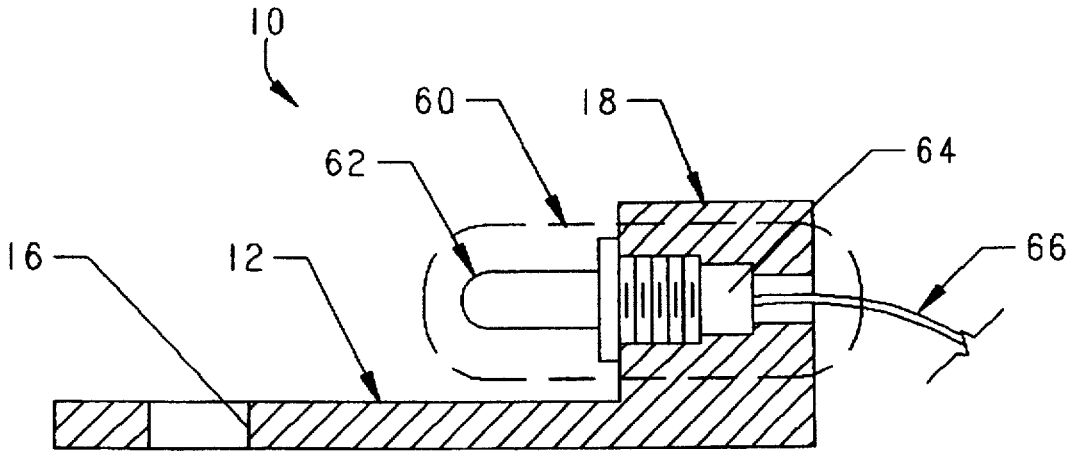
FIG. 6 illustrates a cross-sectional view of the security lock of FIG. 1, with a sensing switch integrated therewith.

FIG. 6 illustrates an electrical switch 60 attached to the security lock shown in FIG. 1. The switch 60 is of a conventional type having a spring-loaded plunger 62 for actuating either normally open or normally closed contacts internal to the body 64 of the switch. The switch 60 is threadably mounted to the blocking member 18 so that the plunger 62 protrudes in the path of the display of the computer. Electrical conductors 66 can be connected to an alarm or monitor system, not shown.

In operation, when the security lock is attached to the laptop computer via the gap, the switch plunger 62 is depressed or forced within the switch body. The state of the switch contacts in this condition represent a secure and safe state. A padlock 18 and tether cable 30 can then be attached via the hole 16 to a fixed object. The limited movement of the blade 12 within the gap prevents movement of the switch plunger 62 to an extent sufficient to change the state of the contacts. Should anyone attempt to remove the security lock, such as by sawing it, the switch contacts will change state when the blade 12 is removed from the gap between the display and keyboard. The alarm or monitor system will detect this change in state of the switch 60 and thereby provide an audible or other type of alarm. As an alternative to the mounting of the switch shown in FIG. 6, a switch can also be mounted in a threaded hole via the front face of the blocking member 18, with the plunger protruding through a hole in the back of the blocking member 18.

A security switch of a leaf-type, or other type, can be mounted to the security lock 10 at locations other than shown in FIG. 6 to sense when the laptop computer is securely attached to the lock 10. Other modifications of the invention to accommodate other security devices will be easily implemented in view of the foregoing.

From the foregoing, an improved security lock for computers has been disclosed. The various embodiments of the security lock of the invention overcome the many disadvantages and shortcomings of the locks heretofore known in the prior art. It should be understood that those skilled in the art may desire to utilize some or a few of the features of the invention, without utilizing all of the disclosed features, and thereby realize the respective advantages of the invention.

While the present invention has been described above with a certain degree of particularity, it is understood that the present disclosure has been made by way of example, and thus changes in detail or structure may be made to the invention without departing from the spirit and scope of the invention, as defined by the appended claims.

What is claimed is:

1. A security lock for a laptop computer of the type having a display mounted for hinged movement to a keyboard, comprising in combination:

a laptop computer having a display mounted for hinged movement with respect to a keyboard, at least a portion of said display being spaced from said keyboard by a gap; and said security lock including a blade having a thickness and constructed of a rugged material having a first end spaced from a second end, said blade being inserted in the gap between the laptop computer display and said keyboard, said blade having fastened thereto at said first end a blocking member that is of a size that cannot pass through the gap, said second end of said blade member being constructed so as to be anchored to a fixed object, whereby said laptop computer is secured to the fixed object.

2. The security lock of claim 1, wherein said blocking member comprises an enlargement formed integral with said blade.

3. The security lock of claim 2, wherein said blocking member is cross-sectionally shaped as a rectangle and formed of a metal material with said blade.

4. The security lock of claim 1, wherein said first end includes an aperture formed therethrough, and said blocking member includes in combination a padlock fastened to said blade via said aperture.

5. The security lock of claim 1, wherein said second end of said blade includes an aperture therethrough, and including a padlock with a shackle for passing through the aperture and through a looped end of a tether cord, said tether cord being fastened to said fixed object.

6. The security lock of claim 1, wherein said blade is made integral with said blocking member to form a unit and wherein said unit is T-shaped.

7. The security lock of claim 1, wherein said blocking member is shaped complementary to a hollow portion of said laptop computer, whereby when the display and keyboard are closed, said blocking member is captured within said hollow portion.

8. The security lock of claim 1, wherein a space between said blocking member and said aperture is somewhat larger than a corresponding thickness of said laptop computer display.

9. The security lock of claim 1, further including an electrical switch for sensing disengagement of the blade from the gap between the computer display and keyboard.

10. The security lock of claim 1, wherein said blade is planar.

11. The security lock of claim 1, wherein said blade member is constructed so as to be removable from said gap without a corresponding removal of screws.

12. A method of securing a laptop computer having a display, a keyboard and a gap therebetween, comprising the steps of:

passing a blade member of a security lock through the gap between the display and keyboard of the laptop computer until a blocking member of the security lock abuts one surface of the laptop computer adjacent the gap;

capturing said blocking member in a recessed area formed within at least one of said display or keyboard, when said display is moved to a closed position overlying said keyboard, attaching a lock to the blade member to prevent reverse movement of the blade member and removal thereof from the gap; and securing the lock to a fixed object, to thereby secure the laptop computer and prevent unauthorized removal.

13. The method of claim 12, further including forming a hole in said blade member and spacing the blocking member from the hole by a distance somewhat greater than a thickness of the computer display.

14. The method of claim 12, further including attaching a switch to said security lock so as to be responsive to removal thereof from said computer.

15. A method of securing a laptop computer having a display, a keyboard and a gap between with a security lock, comprising the steps of:

passing a blade member of the security lock through the gap between the display and the keyboard of the laptop computer until a blocking member abuts at least one surface adjacent the gap and prevents further movement of the blade member;

attaching a lock to the blade member to prevent reverse movement of the blade member and removal from the gap; and securing an anchor device to one of said lock or the blade member, which anchor device is anchored to a fixed object, to thereby secure the laptop computer and prevent unauthorized removal.

16. The method of claim 15, further including using said lock as said blocking member.

17. The method of claim 15, further including securing the anchor device directly to said blade member, via a hole therein.

18. The method of claim 15, further including securing said anchor device to said lock.

19. The method of claim 15 further including utilizing a cable as said anchor device.

* * * * *